US006851195B2

(12) United States Patent
So

(10) Patent No.: US 6,851,195 B2
(45) Date of Patent: Feb. 8, 2005

(54) CAN OPENER

(76) Inventor: Shun So, 2nd Floor, Chuan Yuan Factory Building, 342-344 Kwun Tong Road, Kwun Tong, Kowloon, Hong Kong (CN)

( * ) Notice: Subject to any disclaimer, the term of this patent is extended or adjusted under 35 U.S.C. 154(b) by 0 days.

(21) Appl. No.: 10/436,901

(22) Filed: May 13, 2003

(65) Prior Publication Data

US 2004/0064957 A1 Apr. 8, 2004

(30) Foreign Application Priority Data

Oct. 2, 2002 (GB) ..... 0222823

(51) Int. Cl.[7] ..... B67B 7/72
(52) U.S. Cl. ..... 30/418; 30/416; 30/426
(58) Field of Search ..... 30/410, 416, 417, 30/418, 422, 425, 426, 434, 440, 441

(56) References Cited

U.S. PATENT DOCUMENTS 1,443,783 A * 1/1923 Bauer et al. ..... 30/418
1,628,080 A * 5/1927 Leunen ..... 30/418
5,787,592 A * 8/1998 Lai ..... 30/418
6,058,613 A * 5/2000 So ..... 30/418
6,182,368 B1 * 2/2001 So ..... 30/418

FOREIGN PATENT DOCUMENTS

EP 0 519 646 A2 * 12/1992
GB 2 161 449 A * 1/1986
GB 2 170 172 A * 7/1986
GB 2 327 662 A 2/1999

* cited by examiner

*Primary Examiner*—Hwei-Siu Payer
(74) *Attorney, Agent, or Firm*—Alix, Yale & Ristas, LLP

(57) ABSTRACT

A can opener includes a body with a handle, a traction wheel rotatably mounted on the body, an operating element for turning the traction wheel, and a cutter. The cutter is moveable between an inoperative position for receiving a rim of a can between the traction wheel and cutter, and an operative position for engaging said rim of the can between the traction wheel and cutter. A cam with a lobe engages the cutter and moves it between the inoperative and operative positions. The cam is operated by a lever.

13 Claims, 5 Drawing Sheets

CAN OPENER

BACKGROUND TO THE INVENTION

1. Field of the Invention

The invention relates to manually operable can openers, and in particular to can openers of the laterally-cutting type 2. Background Information Manually operable can openers have been known for many years and may be broadly categorised into three types: a first type having a cutter blade which cuts directly into the top wall of a can, a second type having a cutter blade which cuts into the side wall of the can below the rim, and a third type having a cutter blade which cuts partially into the rim of the can.

The second and third types can be collectively referred to as laterally-cutting types, which are used to remove the end of a can at or below the can rim. Applicant's earlier patents GB 2334939 and GB 2341378 (and corresponding U.S. Pat. No. 6,058,613), the contents of which are considered included as if explicitly set forth herein, describe a can opener that is of this laterally-cutting type.

A typical laterally-cutting type can opener comprises first and second elongate operating elements pivotally connected to each other. Each operating element has a handle portion. One operating element has a rotatable traction wheel pivotally opposite its handle, and the other operating element has a cutter blade pivotally opposite its handle. Movement of the handles relative to each other moves the traction wheel and cutter blade between an inoperative position to receive a rim of a can therebetween and an operative position in which the traction wheel and cutter blade engage the rim of the can During operation of the can opener the two handles must be firmly held together in one hand while an operating handle is turned (to move the can rim between the cutter and traction wheel) with the other hand.

Two problems with the above can opener are that the best position for holding the handles together is often not the most comfortable position for using the opener, and it can be difficult for persons with a weak grip to squeeze the handles together with sufficient force during operation of the can opener to properly engage the can rim between the cutter and traction wheel.

It is an object of the present invention to overcome or ameliorate these problems.

SUMMARY OF THE INVENTION

According to a first aspect of the invention there is provided a can opener including:

a body with a handle, a traction wheel rotatably mounted on the body, an operating element for turning the traction wheel, a cutter movable between an inoperative position for receiving a rim of a can between the traction wheel and cutter, and an operative position for engaging said rim of the can between the traction wheel and cutter, a cam with a lobe for engaging the cutter and moving it between the inoperative and operative positions, and a lever for operating the cam.

Preferably, the handle has a cavity into which the level is received when the cutter is in the operative position.

Preferably, the can opener includes a lock for releasably securing the lever in the recess.

Preferably, the cutter is biased in the inoperative position.

Preferably, the cam comprises an elongate member with the lobe proximate a first end, a pivot for the lever is adjacent a second end of the cam, and the lever has a tab engaging the elongate member proximate the second end.

Preferably, the cutter comprises a carriage plate and cutter arid the lobe engages the carriage plate.

Preferably, the can opener includes a first jaw portion disposed on the body, and a second jaw portion disposed on the carriage plate.

Preferably, the can opener is of the lateral cutting type.

Further aspects of the invention will become apparent from the following description, which is given by way of example only.

BRIEF DESCRIPTION OF THE DRAWINGS

Embodiments of the invention will now be described with reference to the accompanying drawings in which.

DESCRIPTION OF THE PREFERRED EXAMPLES

Figure 1:
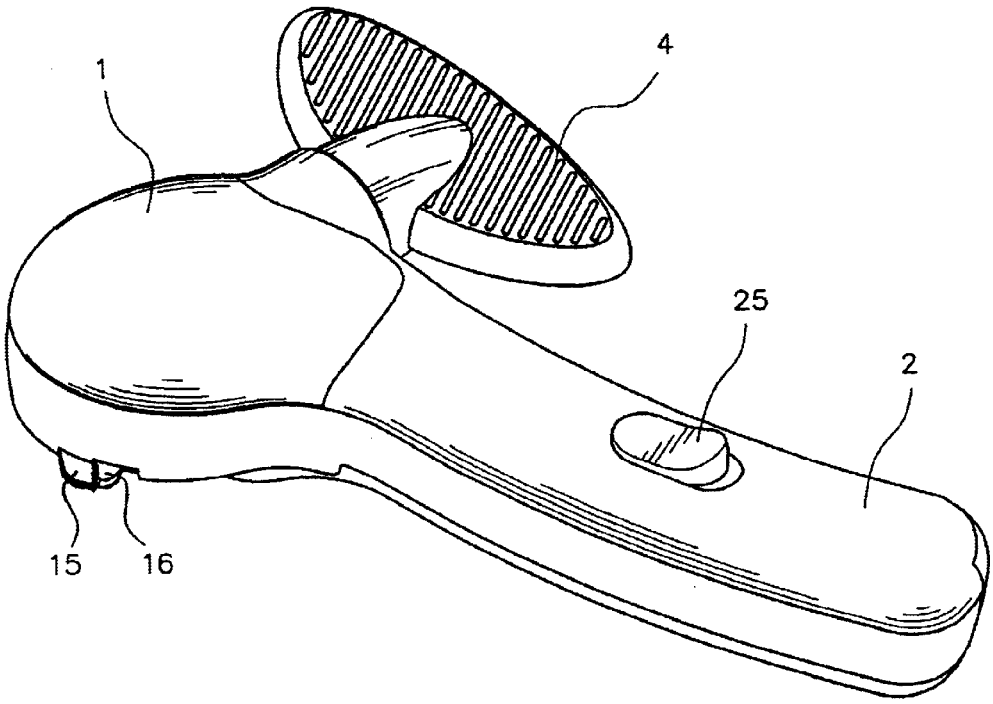
FIG. 1 is an perspective view of a can opener according to the invention.
Figure 2:
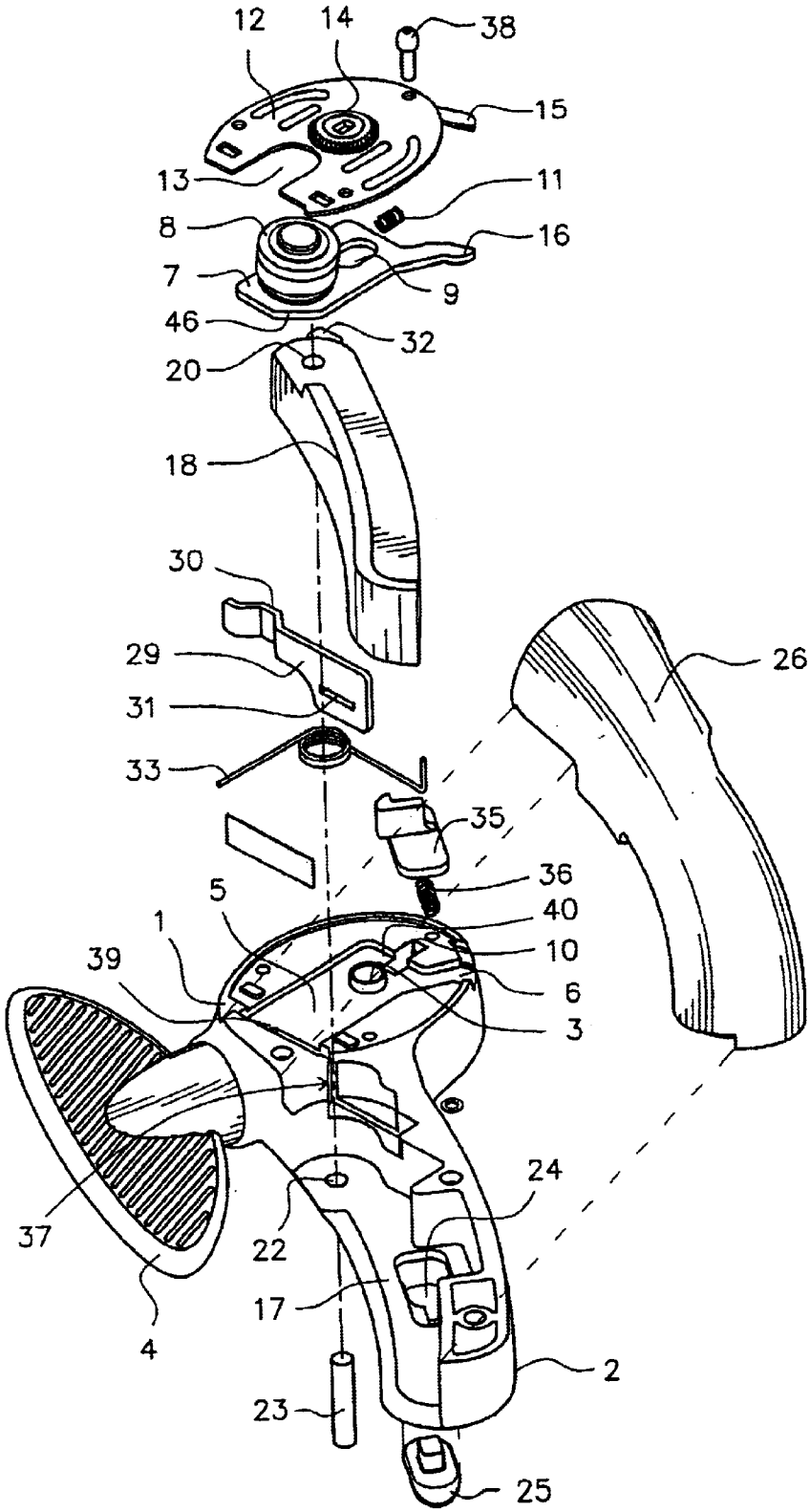
FIG. 2 is an exploded view of the can opener.

Referring to FIGS. 1 to 4, a can opener comprises a body portion 1 with an integrally formed handle 2 extending therefrom within the body 1 is a 90-degree gear with its output shaft 45 (not shown in FIG. 2) extending through an aperture 3 in the face of body 1. The input of the 90-degree gear is an operating handle 4 for manually operation of the output shaft 45. The output end of the output shaft 45 is keyed for engagement with a traction wheel 14.

The face of body 1 has a rectangular recess 5 with a channel 6 extending from a corner of the recess 5 to the edge of body 1. A rectangular carriage plate 7 locates within recess 5 The carriage plate 7 is longitudinally shorter than the recess 5 so that it can move longitudinally in the recess 5 from a first position proximate recess first end 39 to second position proximate recess second end 40. At recess second end 40 is a smaller cylindrical recess 10 that receives a spring 11 for biasing the carriage plate 7 in the first position.

A corner of carriage plate 7, adjacent top edge 39 of recess 5, is cut away to form a bevelled edge 40.

A cutter wheel 8 of known type is rotatably mounted on carriage plate 7 and moves between first and second positions as carriage plate 7 so moves. An elongate slot 9 in carriage plate 7 accommodates aperture 3 and the output shaft 45 therethrough. An arm extending from a corner of the carriage plate 7 has a first jaw 16 at its end. The arm locates within channel 6 of recess 5 and the jaw 16 extends out of channel 6 and past the edge of body 1.

Figure 3:
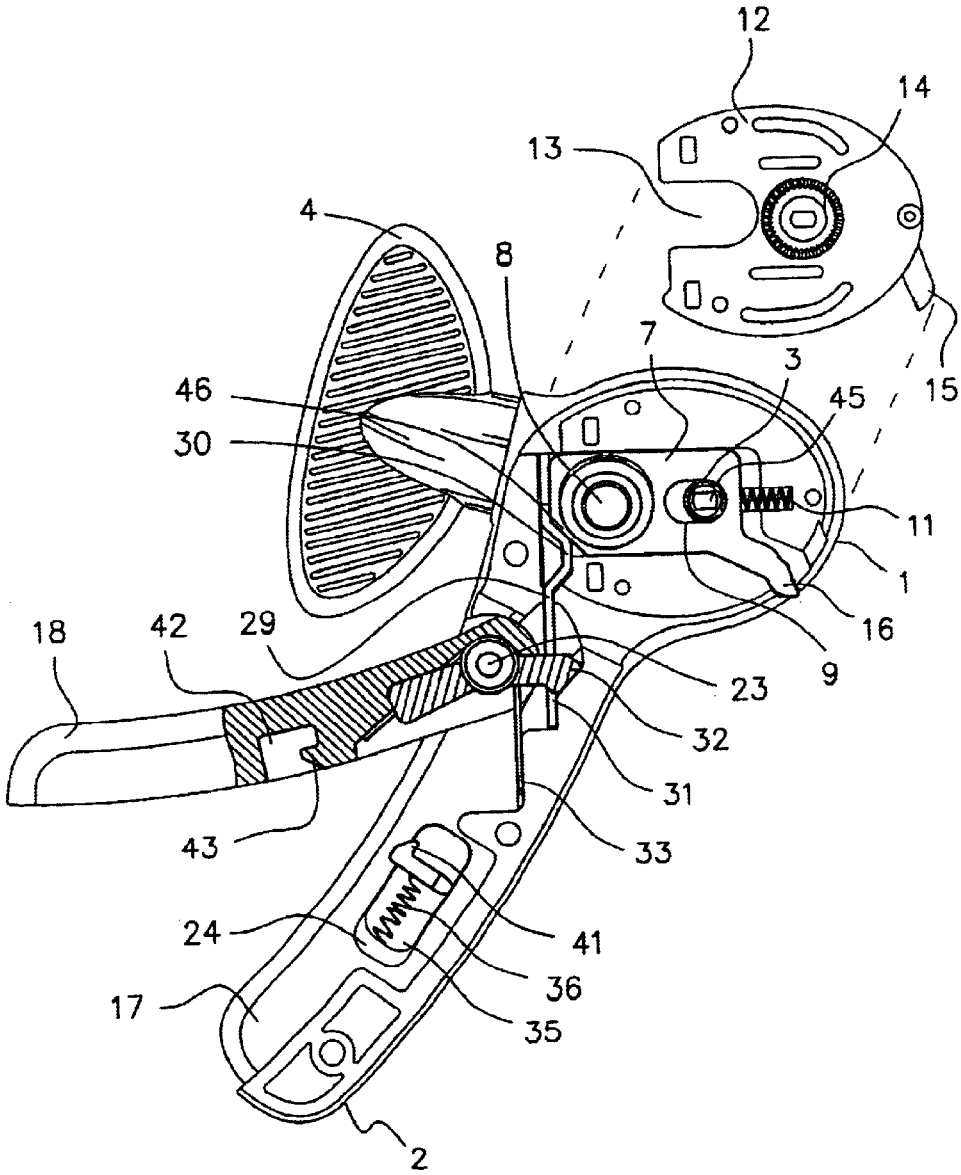
FIG. 3 is a first sectional view through the can opener.
Figure 4:
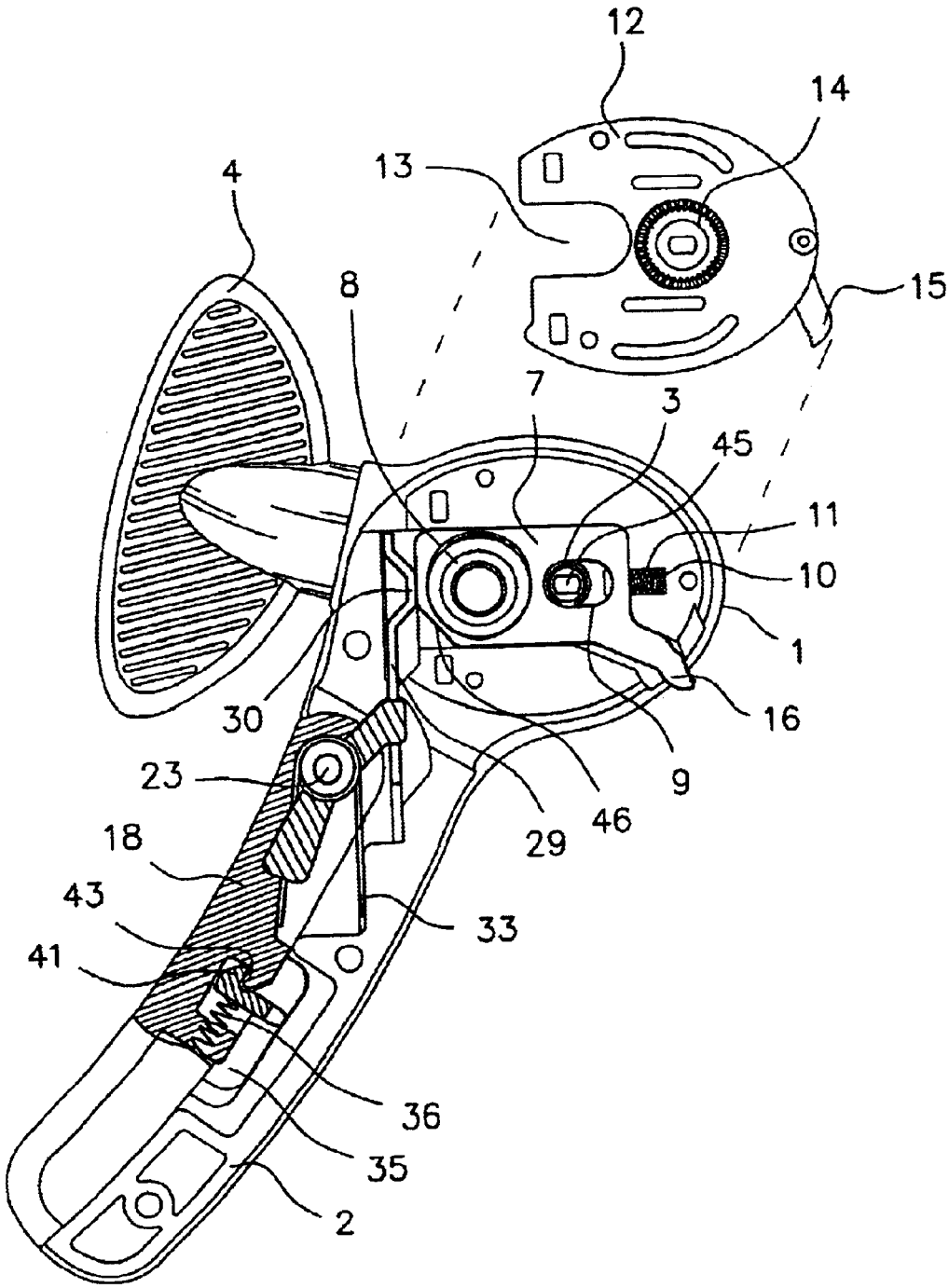
FIG. 4 is a second sectional view through the can opener.

Along the top edge 39 of recess 5 is a deep elongate slot 37 within body 1. A cam plate 29 locates within slot 37 and is slideable longitudinally within the slot 37. Proximate a first end of the cam plate 29 is a lobe 30 which extends into recess 5 adjacent its top edge 39. The lobe 30 moves transversely along the top edge 30 of recess 5 as the cam plate 29 moves longitudinally within slot 37. When the cam plate 29 is in a first position within slot 37 the lobe 30 is adjacent the bevelled edge 46 of carriage plate 7 which is in its first position within recess 5. This position is illustrated in FIG. 3. When the cam plate 29 is moved longitudinally within slot 37 the lobe 30 moves transversely along the top edge 39 of recess 5. The lobe 30 rides up bevelled edge 46 of carriage plate 7 moving it longitudinally within recess 5 to its second position adjacent second end 40 of recess 5, as illustrated in FIG. 4.

The handle 2 has a cavity 17 into which a lever 18 is received. In the illustrated embodiment a side 26 of handle 2 is shown separately formed. During assembly of the can opener this side 26 is firmly secured to the handle 2 by glue or screw fixings. In alternative embodiments the handle is formed in one piece.

At the proximal end of the handle 2 is a first bore 22. Bore 22 and a through hole 20 in lever 18 receives pivot pin 23 The lever 18 pivots between an open position, as shown in FIG. 3, and a closed position, as shown in FIG. 4. A spring clip 33 at the pivot 23 biases the lever 18 in the open position. The handle 2 has an opening 24 in the wall of cavity 17 through which a lock is located.

The lock comprises an operating switch 25 on the outer surface of the handle 2, and a catch 35 within cavity 17. A lock spring 36 biases the switch 25 and catch 35 in a locking position. The underside of lever 18 has a cavity 42 into which the catch 35 locates when the lever 18 is in the closed position. A tab 41 of catch 35 engages a lip 43 of cavity 42 to releasably secure the lever 18 in the closed position. The lock is released by moving the switch 25 against the lock spring 36 bias to disengage tab 41 from lip 43.

The lever 18 has a tab 32 at its pivot end which engages a slot 31 in the second end of cam plate 29. The tab 32 acts as a linkage to move cam plate 29 longitudinally within slot 37 as lever 18 moves between its open and closed positions.

A cover plate 12 locates over the face of body 1 and is secured by a plurality of screws 38. The cover plate 12 bears a traction wheel 14 which engages with the keyed output end of output shaft 45 for rotation via operating element 4. The cover plate 12 has a cutaway portion 13 extending inwardly from its top edge. Cut away portion 13 accommodates movement of cutter wheel 8, relative to traction wheel 14, as carriage plate 7 moves within the recess 5 underneath the cover plate 12.

Figure 5:
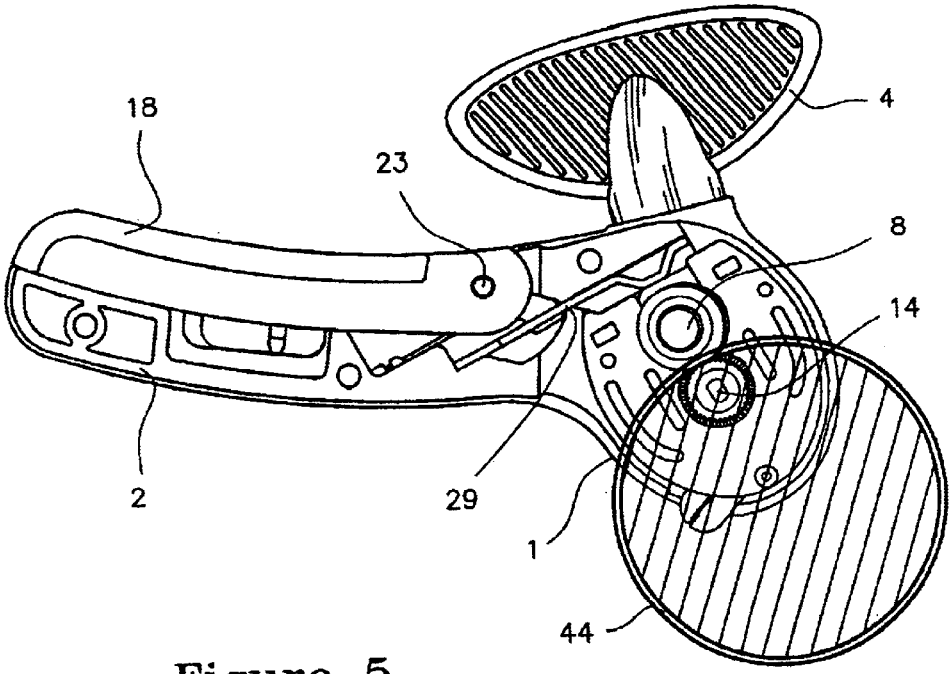
FIG. 5 illustrates a rim of a can engaged by the can opener.

Referring to FIG. 5, when carriage plate 7 is in its first position proximate top edge 39 of recess 5 the cutter wheel 8 is in an inoperative position whereby a can rim 44 may he located between the cutter wheel 8 and traction wheel 14. When lever 18 is moved into cavity 17 of handle 2, the carriage plate 7 is engaged by lobe 30 of cam 29 and moves to its second position proximate recess second end 40. In this position the cutter wheel 8 is in an operative position wherein the can rim 44 is engaged between the cutter wheel 8 and traction wheel 14. Turning operating handle 4 causes the can rim 44 to move between the cutter wheel 8 and traction wheel 14 slicing the rim of the can.

Figure 6:
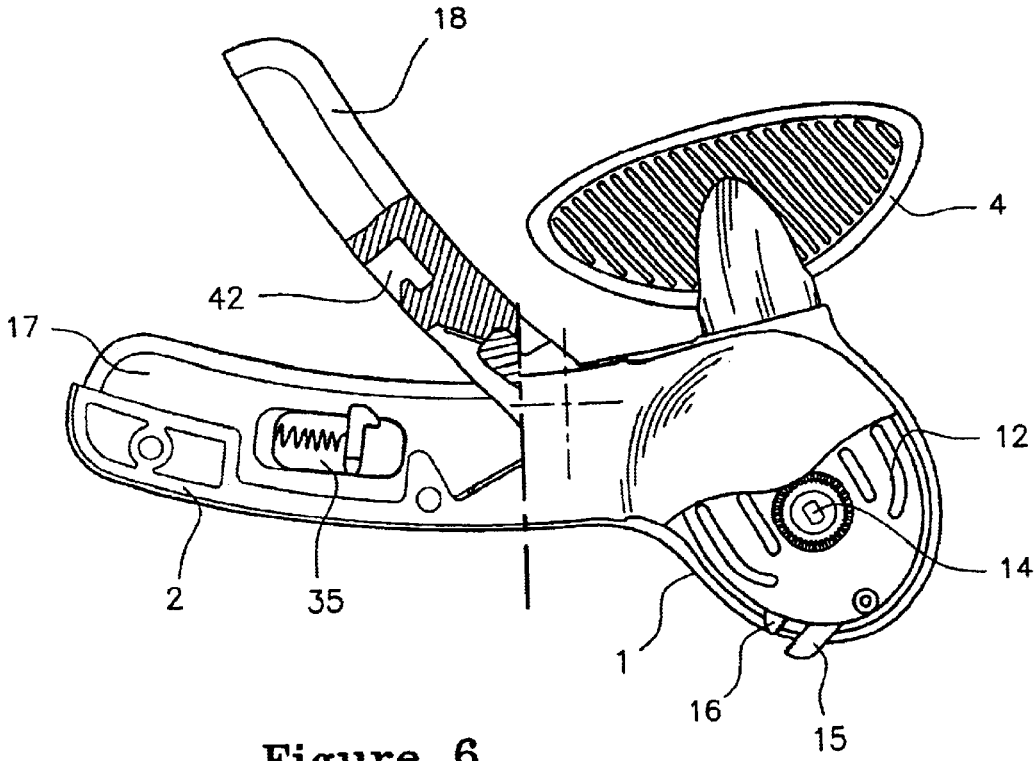
FIG. 6 illustrates open jaws on the can opener.

Cover plate 12 has a second jaw portion 15 at its edge. The second jaw 15 is arranged to be proximate the edge of channel 6 where the first jaw portion 16 extending from carriage plate 7 extends passed the edge of body 1. The two jaw portions 15, 16 form a gripping member which is used to grip the rim 44 of the can after cutting with the can opener so that the can end can be removed effortlessly and safely. Because the first jaw 16 is a part of carriage plate 7 the jaws 15, 16 move from an open position, as shown in FIG. 6, when carriage plate 7 is in its first position to a closed position, as shown in FIG. 1, when the carriage plate 7 is in its second position.

In the preferred embodiment a cam plate 29 is utilised. The cam plate 29 is moved longitudinally by the lever 18 and a cam lobe 30 engages carriage plate 7 to move it between its first and second positions. In an alternative embodiment the pivot 23 of lever 18 is located adjacent the top edge 39 of recess 5. An oval cam with a lobe is mounted about pivot 23 and operation of lever 18 engages the lobe against the top of carriage plate 7 for movement between its first and second positions.

Where in the foregoing description reference has been made to integers or elements having known equivalents then such are included as if individually set forth herein.

Embodiments of the invention have been described, however it is understood that variations, improvements or modifications can take place without departure from the spirit of the invention or scope of the appended claims.

What is claimed is:

1. A can opener including:

a body with a handle;

a traction wheel rotatably mounted on the body;

an operating element for turning the traction wheel;

a cutter movable between an inoperative position for receiving a rim of a can between the traction wheel and the cutter, and an operative position for engaging said rim of the can between the traction wheel and cutter;

a cam with a lobe for engaging the cutter and moving it between the inoperative and operative positions; and a lever for operating the cam.

2. The can opener of claim 1 in which the handle has a cavity into which the lever is received when the cutter is in the operative position.

3. The can opener of claim 2 including a lock for releasably securing the lever in the cavity.

4. The can opener of claim 1 in which the cutter is biased in the inoperative position.

5. The can opener of claim 1 in which the cam comprises an elongate member with the lobe proximate a first end, a pivot for the lever is adjacent a second end of the cam, and the lever has a tab engaging the elongate member proximate the second hand.

6. The can opener of claim 1 in which the cutter comprises a carriage plate with a cutter wheel and the lobe engages the carriage plate.

7. The can opener of claim 6 including a first jaw portion disposed on the body, and a second jaw portion disposed on the carriage plate.

8. A can opener including:

a body with a handle;

a traction wheel rotatably mounted on the body;

an operating element for turning the traction wheel;

a cutter movable between an inoperative position for receiving a rim of a can between the traction wheel and the cutter, and an operative position for engaging said rim of the can between the traction wheel and cutter;

a cam having a slider with a lobe for engaging the cutter and moving it between the inoperative and operative positions; and a lever with a tab for engaging the slider and operating the cam.

9. The can opener of claim 8 in which the handle has a cavity into which the lever is received when the cutter is in the operative position.

10. The can opener of claim 9 including a lock for releasably securing the lever in the cavity.

11. The can opener of claim 8 in which the cutter is biased in the inoperative position.

12. The can opener of claim 8 in which the cutter comprises a cutter wheel rotatably mounted on a carriage plate.

13. The can opener of claim 12 including a first jaw portion disposed on the body, and a second jaw portion disposed on the carriage plate.

* * * * *